US006498554B2

(12) United States Patent
Chow

(10) Patent No.: US 6,498,554 B2
(45) Date of Patent: Dec. 24, 2002

(54) AUXILIARY WIRING STRUCTURE FOR STABILIZER

(76) Inventor: Albert Chow, 3F, No. 1, Lane 37, Ming-Yuan St., Sanchung City, Taipei Hsien (TW)

( * ) Notice: Subject to any disclaimer, the term of this patent is extended or adjusted under 35 U.S.C. 154(b) by 0 days.

(21) Appl. No.: 09/805,907

(22) Filed: Mar. 15, 2001

(65) Prior Publication Data

US 2002/0130751 A1 Sep. 19, 2002

(51) Int. Cl.[7] ..... H01F 27/30; H01F 27/24

(52) U.S. Cl. ..... 336/199; 336/192; 336/234; 336/213

(58) Field of Search ..... 336/213, 234, 336/229, 199, 192; 315/248, 370, 344; 313/440; 335/210, 213; 29/606

(56) References Cited

U.S. PATENT DOCUMENTS 4,587,507 A * 5/1986 Takayama et al. ..... 336/178
4,761,629 A * 8/1988 Martin et al. ..... 336/208
4,833,436 A * 5/1989 Martin et al. ..... 336/60
5,214,403 A * 5/1993 Bogaerts et al. ..... 336/84 C
5,319,341 A * 6/1994 Bisbee et al. ..... 336/67
5,488,344 A * 1/1996 Bisbee et al. ..... 336/206

* cited by examiner

*Primary Examiner*—Anh Mai
(74) *Attorney, Agent, or Firm*—Bacon & Thomas

(57) ABSTRACT

An auxiliary wiring structure for stabilizer which includes a ferrite core and a separator. The ferrite core is assembled by annular silicon sheets and has a slot formed at a selected location. The separator is clamped in the slot and enables wiring for a coil around the ferrite core be done in a well organized layer structure thereby to provide a stable current output for discharging lamp tube or other electric devices use.

6 Claims, 5 Drawing Sheets

AUXILIARY WIRING STRUCTURE FOR STABILIZER

BACKGROUND OF THE INVENTION

This invention relates to an auxiliary wiring structure for stabilizer and particularly a ferrite core made of silicon steel sheets clamping a separator for improving wiring process for the coil which surrounds the ferrite core and providing a stable current output.

The commonly used fluorescent light, mercury light, sodium light and the like all have a discharging lamp tube. The discharging lamp tube uses the ionization effect of gas to generate light. Taking the fluorescent light for instance, the two ends of the lamp tube have respectively a small coil of filament sealed therein. The filament is coated with an oxide. When electric current flows through the filament, the temperature of the filament will increase and release a great amount of electrons. The lamp tube contains mercury and argon gases. When a high voltage is applied to the two ends of the lamp tube, the electrons in the lamp tube will be attracted by the positive electrodes and move in high speed to hit the gas molecules. The gas molecule will be ionized and releases one or more electrons. This process continues. In order to maintain a safe current, a stabilizer must be provided to limit the current.

The stabilizer is constructed by a ferrite core made of a plurality of silicon steel sheets formed in a shape and a coil surrounding the center portion of the ferrite core. The coil has two ends soldered to a circuit board. After the ferrite core is wound by the coil around its magnetic path, the stabilizer becomes very bulky. Furthermore, the wiring of the coil is made in an irregular manner on the ferrite core and cannot effectively provide the discharging lamp tube a stable current required.

SUMMARY OF THE INVENTION

The primary object of this invention therefore is to resolve the disadvantages of the conventional stabilizer set forth above. This invention uses annular silicon steel sheets to form a ferrite core and has a slot formed in the ferrite core for clamping a separator. The separator has a portion extended outside the ferrite core to become a fastening section for holding the starting wire end of a coil and to serve as a reference base for jumper during automatic wiring thereby the wired coil has a well organized layer structure and may provide a stable current output.

Another object of this invention is to provide a ferrite core formed by annular silicon steel sheets which, after being surrounded by the coil, will make the stabilizer a smaller size.

A further object of this invention is to enable the stabilizer equipping choke and inductance function when it is used in the loop of general electric devices.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENTS

Figure 1:
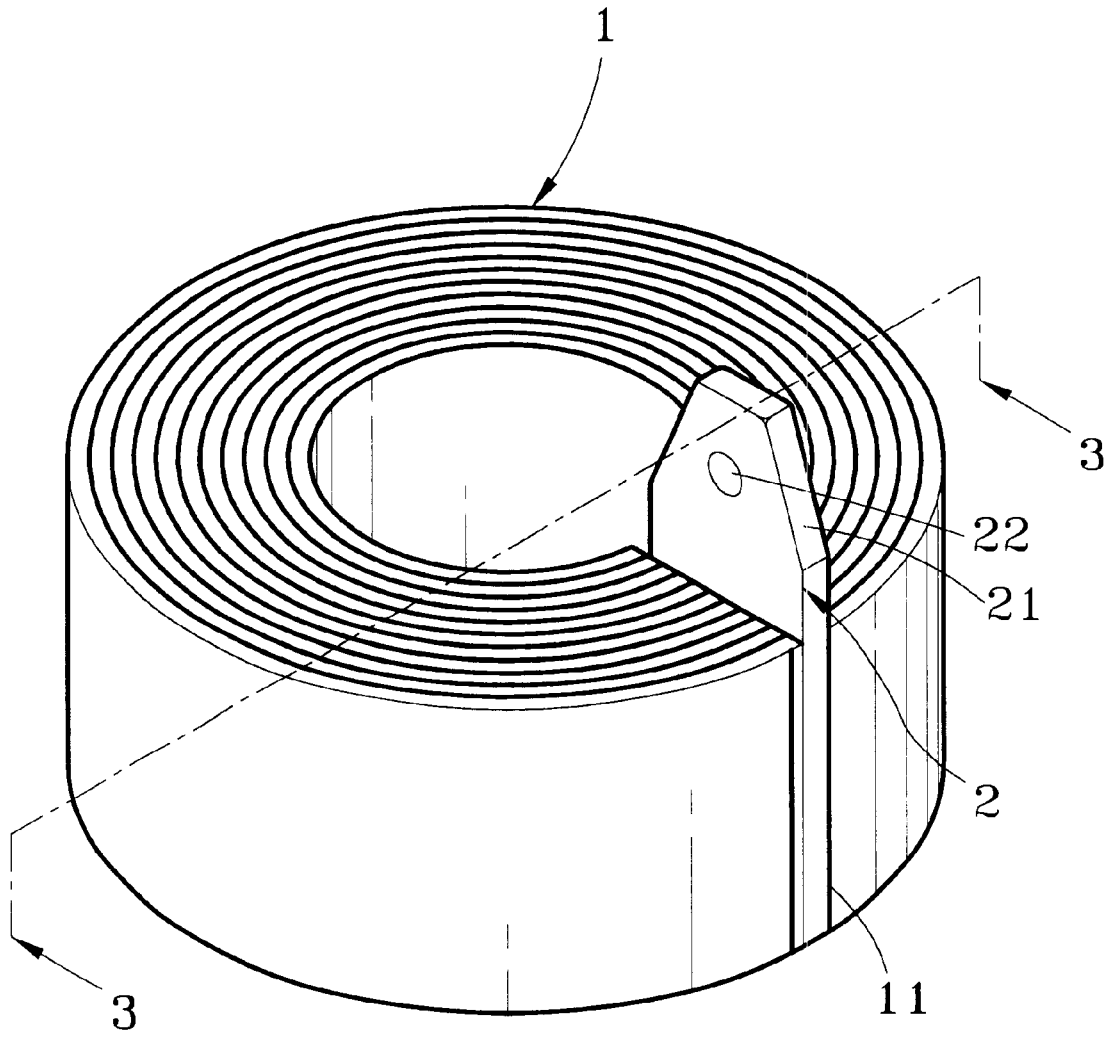
FIG. 1 is a perspective view of this invention.
Figure 2:
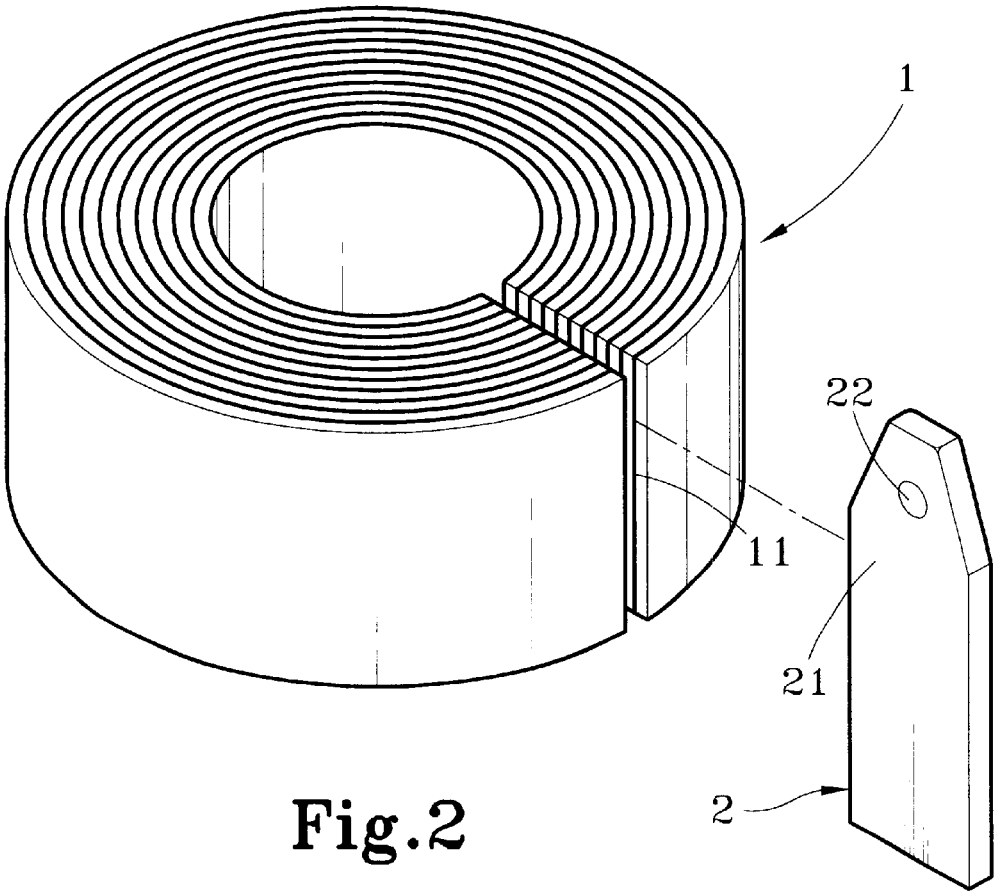
FIG. 2 is an exploded view of this invention.

Referring to FIGS. 1 and 2, the stabilizer according to this invention includes a ferrite core 1 and a separator 2. The ferrite core 1 is made by assembling a plurality of annular silicon sheets and has a slot 11 formed at a selected location. The separator 2 is made of a hard material and located in the slot 11, and has a portion extended outside the ferrite core 1 to form a fastening section 21 which may be used for engaging with the starting wire head (not shown in the drawings) of a coil and the reference base of jumper during automatic wiring. The ferrite core 1 thus formed may be used for the stabilizer. The separator 2 further has a hanging bore 22 to facilitate transportation (hanging) during production process.

Figure 3:
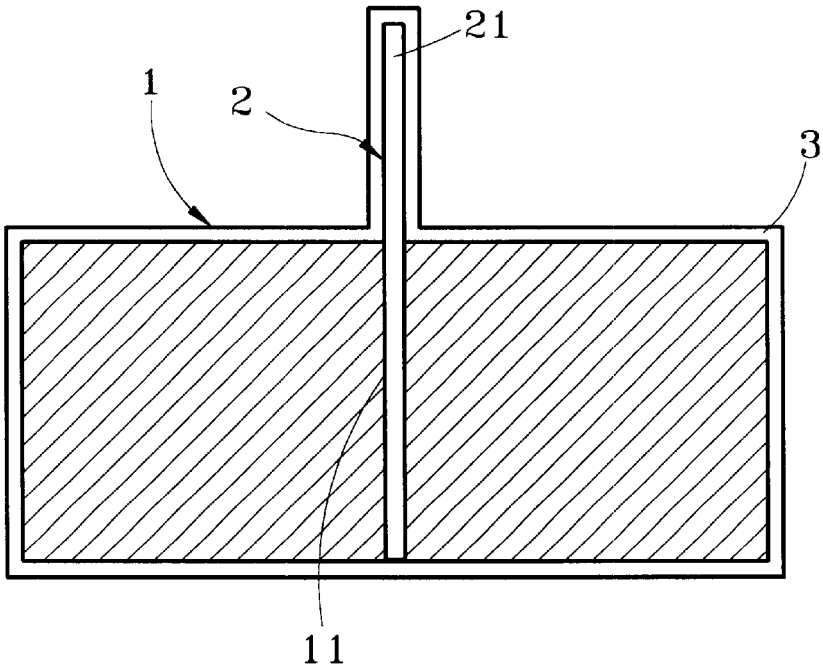
FIG. 3 is a cross sectional view of this invention taken along line 3—3 in FIG. 1.

Referring to FIG. 3, once the separator 2 is being clamped in the slot 11 of the ferrite core 1, the ferrite core 1 and separator 2 may be hung through the hanging bore 22 for spraying an insulation layer 3 thereon to ensure that the coil (nor shown in the drawing) won't contact the ferrite core 1.

Figure 4A:
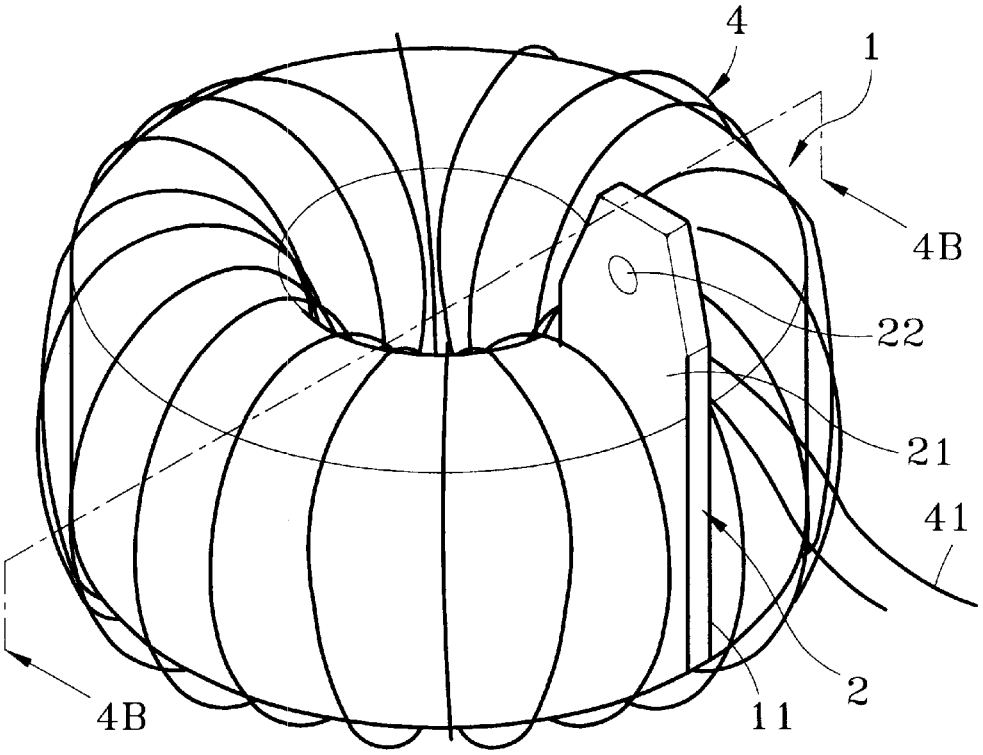
FIG. 4A is a schematic view of the stabilizer surrounded by a coil according to this invention.
Figure 4B:
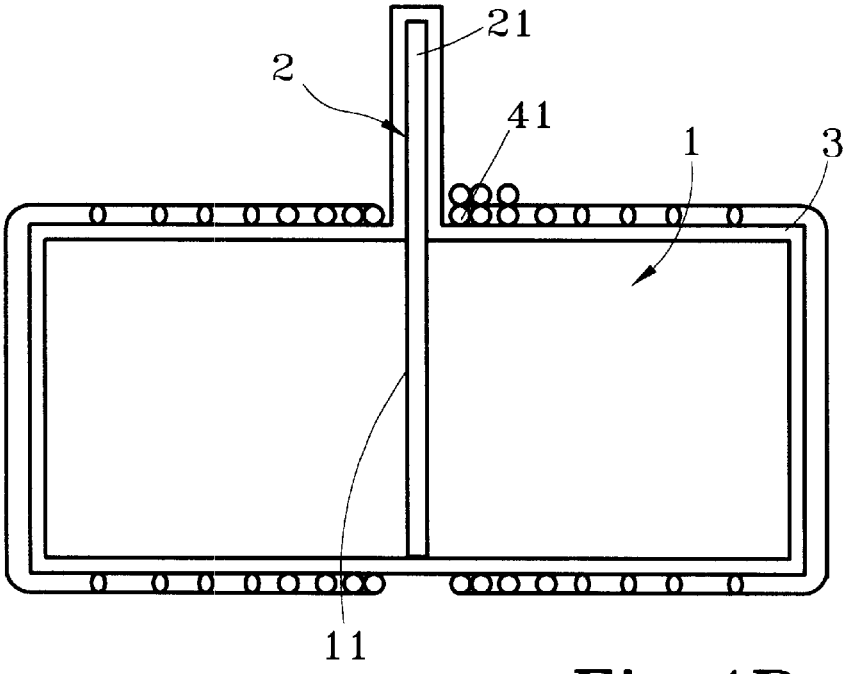
FIG. 4B is a cross sectional view taken along line 4B—4B in FIG. 4A.
Figure 8:
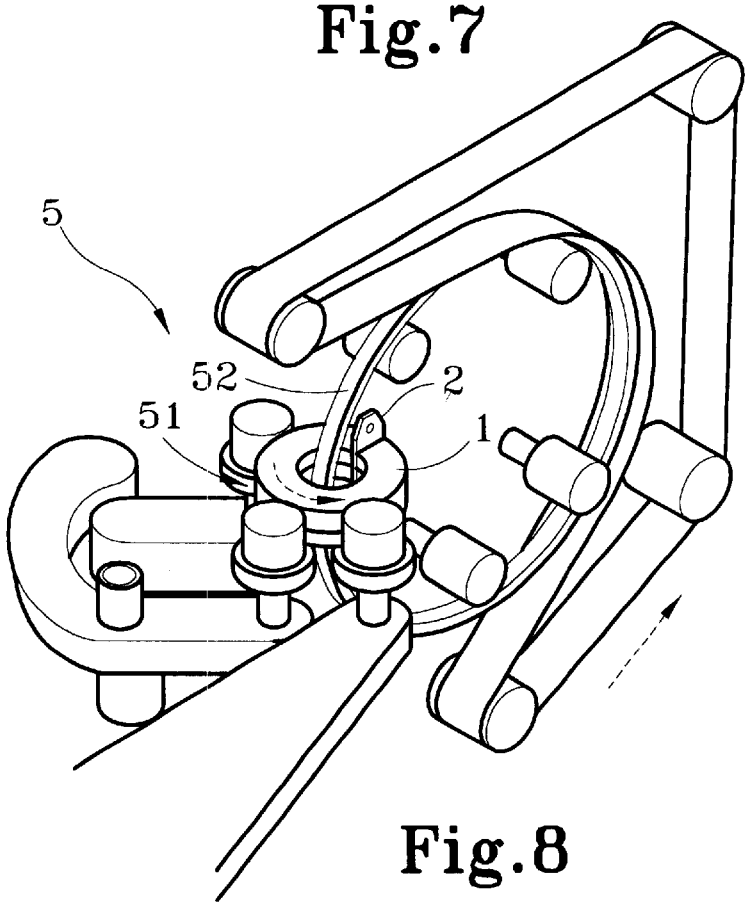
FIG. 8 is a schematic view of this invention, at a wiring state.

Referring to FIGS. 4A and 8, for wiring the coil, the stabilizer is disposed in a chuck 51 of the wiring machine 5. When the wiring process starts, a wire head 41 of the coil 4 is drawn from a wire bracket 52 and fastened to one side of a fastening section 21 of the separator 2 (as shown in FIG. 4 A). After the wire is being wound around one loop, the coil 4 jumps over the fastening section 21 to proceed the wiring of the second layer. The wire head 41 is being pressed under the second layer and held stationary (shown in FIG. 4B), then the wiring machine may be started. The wiring bracket will rotate in counterclockwise direction and winds the coil 4 over the ferrite core 1 until the winding of the coil is completed.

As the wire head 41 is fastened to one side of the fastening section 21 of the separator 2, the wire head 41 won't be entangled into the coil 4 during the winding process. The wire head 41 is easy to locate after winding is completed and the coil may be smoothly wound without creating entangled wiring.

Furthermore, the separator 2 may serve as the reference base of jumper when winding another layer of wire for the coil 4 thereby the coil 4 will have a smooth and neatly organized layer structure to enable the stabilizer forming a desirable magnetic path to output a stable current. It thus can give the discharging lamp tube a good quality stabilizing effect.

Figure 5:
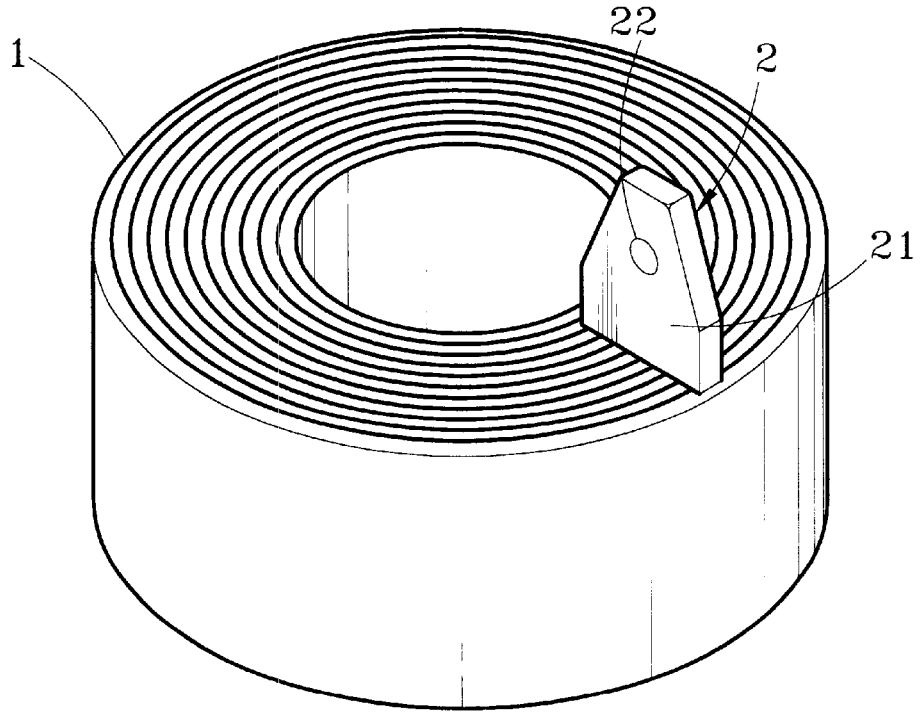
FIG. 5 is a schematic view of another embodiment of this invention.
Figure 6:
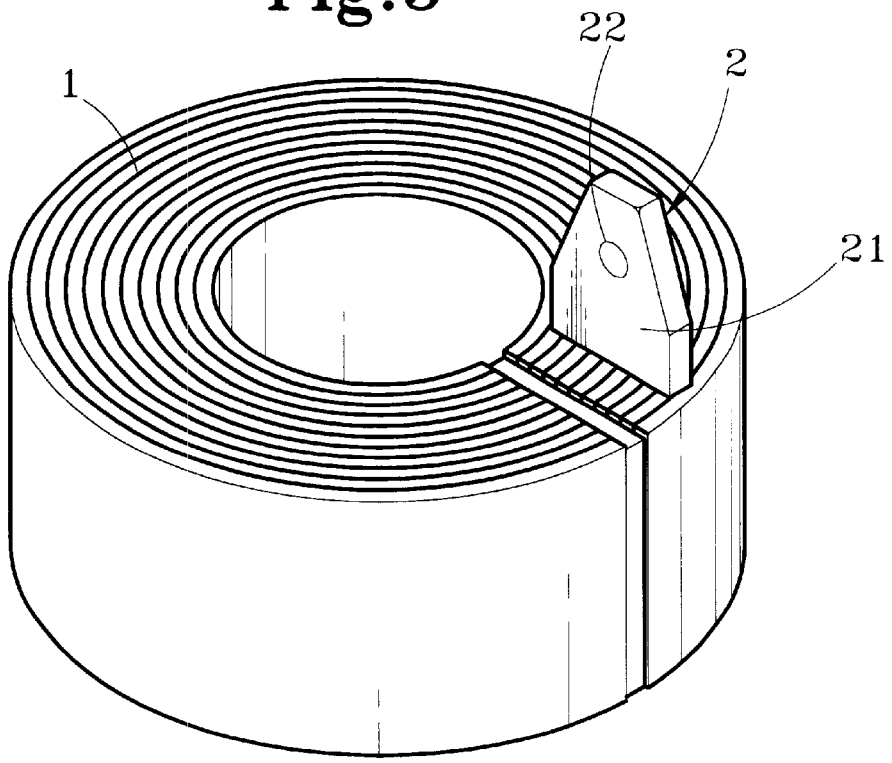
FIG. 6 is a schematic view of yet another embodiment of this invention.

Moreover the separator 2 may be directly and integrally formed with the ferrite core 1 (as shown in FIG. 5), or be designed by section. A first section of the separator 2 may be fastened to the ferrite core 1, then a second section (fastening section 21) may be integrally formed with the ferrite core 1 or be fixedly mounted on the ferrite core 1 (as shown in FIG. 6).

The separator 2 may also be formed in a needle shape and serve as a soldering leg for directly soldering to the circuit board. The needle shaped separator 2 may also be used to fasten the starting wire head through a coupled sleeve.

Figure 7:
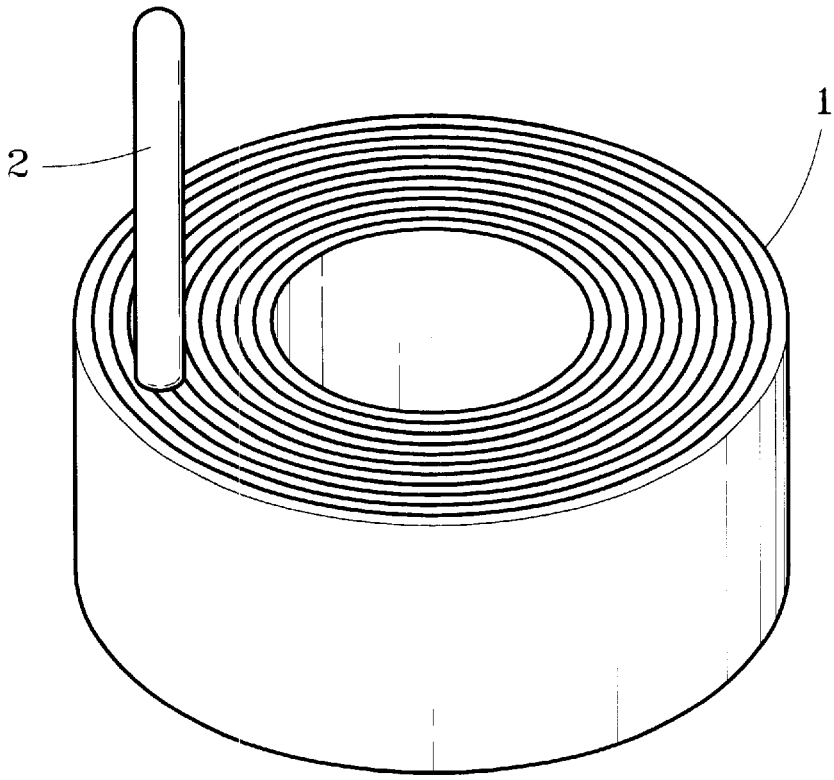
FIG. 7 is a schematic view of still another embodiment of this invention.

When the coil is finished, an insulation layer may be applied thereon. The insulation layer may be a covering insulation paint, or an upper and lower cap member (or an upper cap and a lower cap) to cover the coil for providing a complete insulation (as shown in FIG. 7). In addition, when the stabilizer of this invention is in use with the loop of a general electric device, the well organized layer structure of this invention will provide a stable current output and offer choke and inductance function.

What is claimed is:

1. An auxiliary wiring structure for stabilizer, comprising:

a ferrite core with a coil wound around thereon having a slot formed at a selected location; and a separator clamped in the slot having a portion extended outside the slot to form a fastening section for fastening a starting wiring head of the coil and serving as a reference base for jumper during an automatic wiring process of the coil thereby to give the coil an effective wiring and the stabilizer a stable current output, and wherein the separator is formed in a needle shape and serves as a solder leg.

2. The auxiliary wiring structure for the stabilizer of claim 1, wherein the separator has a hanging bore to enable the separator and ferrite core to be hung for painting an insulation layer at the outside surface of the separator and ferrite core.

3. The auxiliary wiring structure for the stabilizer of claim 1, wherein the separator and the ferrite core are directly formed integrally.

4. The auxiliary wiring structure for the stabilizer of claim 1, wherein the separator includes a first section which is fastened to the ferrite core and a second fastening section which is integrally formed with the ferrite core or are fixedly fastened to the ferrite core.

5. The auxiliary wiring structure for the stabilizer of claim 1, wherein the coil has an insulation layer disposed thereon, the insulation layer being selectively an insulation paint covering the coil, or an upper and a lower cap covering the coil for completely isolating the coil.

6. An auxiliary wiring structure for stabilizer, comprising:

a ferrite core of annular silicon steel sheets with a coil wound around thereon and having a slot formed at a selected location; and a separator clamped in the slot having a portion extended outside the slot to form a fastening section for fastening a starting wire head of the coil and serving as a reference base for jumper during automatic wiring process thereby to give the coil an effective wiring and the stabilizer a stable current output.

* * * * *